United States Patent [19]

Trainer

[11] Patent Number: 4,534,448

[45] Date of Patent: Aug. 13, 1985

[54] SCAFFOLD CLAMP

[76] Inventor: Peter C. Trainer, 4 Dogwood La., Easton, Conn. 06612

[21] Appl. No.: 463,294

[22] Filed: Feb. 2, 1983

[51] Int. Cl.[3] ..... E04G 5/08; E04G 7/28

[52] U.S. Cl. ..... 403/396; 182/223; 182/222; 24/278; 24/481; 24/486; 428/58

[58] Field of Search ..... 24/205.13 R, 14 R, 14 K, 24/19, 274 R, 277, 263 A, 243 B, 278; 182/222, 223, 204, 214; 403/396

[56] References Cited

U.S. PATENT DOCUMENTS

| | | | |
|---|---|---|---|
| 575,857 | 1/1897 | Sly | 182/187 |
| 1,528,268 | 3/1925 | Schlegel | 182/187 |
| 1,980,854 | 11/1934 | Eberle | 182/214 |
| 2,360,640 | 10/1944 | Bengert | 182/204 |
| 4,187,929 | 2/1980 | Cyr | 182/222 |

FOREIGN PATENT DOCUMENTS

| | | | |
|---|---|---|---|
| 1006056 | 9/1965 | United Kingdom | 24/263 A |

*Primary Examiner*—Reinaldo P. Machado
*Attorney, Agent, or Firm*—Philip M. French

[57] ABSTRACT

Improved scaffold clamps are described. These clamps provide a complete enclosure means for securing a plurality of planks in side-by-side relationship. The enclosure means bears a rigid working plate with a press screw extending longitudinally therethrough for exerting pressure against the edges of the enclosed planks. These clamps provide an improved means for stabilizing scaffold platforms.

6 Claims, 4 Drawing Figures

1
2
2'
2''
3
4
5
6
7
8
9
10
11
12

4
6
15
15'
15''
15'''
16
16'
17
17'

3
6
7
13
14

1
3
8
9
10
11
12
18
19
20
21
22
22'
22''
23

SCAFFOLD CLAMP

INTRODUCTION TO THE INVENTION

The present invention relates to clamps which may be employed for securing a plurality of planks in side-by-side relationship to form a unitary scaffold platform.

Improved scaffold clamps are described. These clamps provide a complete enclosure means for securing a plurality of planks in side-by-side relationship. The enclosure means bears a rigid working plate with a press screw extending longitudinally therethrough for exerting pressure against the edges of the enclosed planks. These clamps provide an improved means for stabilizing scaffold platforms.

Despite the frequency of their use, scaffolding planks heretofore known and used were often only marginally safe. They were generally composed of from two to four planks placed in approximately side-by-side relationship to form a flooring upon which to stand and work. Because such platforms were often used in one place for only a short time, the planks were generally simply laid across end supports without any restraint on movement.

By virtue of their composite nature, they often proved dangerous. Different planks in a scaffold generally react differently to loads. The resultant and individual flexure of given planks thereby constitutes a footing safety problem which becomes especially great when distances of ten feet, twelve feet and more are spanned.

Further, wood planks weaken with age and exposure to the elements, while even new planks may fail due to cross grain and large knots. As workmen negotiate heavy materials on scaffolds, great loads are often carried by a single plank. Accidents resulting from plank breakage can easily result in serious injury, long-term disability or loss of life.

One object of this invention involves the provision of a simple and inexpensive clamp which is applied temporarily to join together separate planks to form a safe scaffold platform.

A further object of this invention involves a scaffold clamp which will minimize independent flexure or movement of separate planks constituting a platform so as to increase the safety of its use.

A further object of this invention is to reduce the hazard of plank breakage during use.

A further object of this invention involves a clamp which is so readily employed to secure scaffolds as to encourage its use.

A yet further object of this invention involves provision of a clamp which will itself pose no, or only a negligible, footing hazard when in use.

Still further objects involve increased productivity of workmen resulting from the security of working on a more rigid platform and ultimately a lower accident rate and consequent lower insurance costs.

The scaffold clamps shown and described herein satisfy the foregoing objectives. They provide safe and inexpensive means to readily stabilize multi-plank platforms.

With the foregoing and such other objects as will appear in view, this invention resides in the combination and arrangement of parts and in the details of and advantages of use hereinafter described and claimed. It is therefore intended to include all minor changes or modifications of the examples which follow for the purpose of disclosure, which changes or modifications do not constitute a departure from the spirit and scope of this invention.

INTRODUCTION TO THE DRAWINGS

This invention is illustrated in the accompanying drawings wherein.

DESCRIPTION OF THE INVENTION AND DRAWINGS

Figure 1:
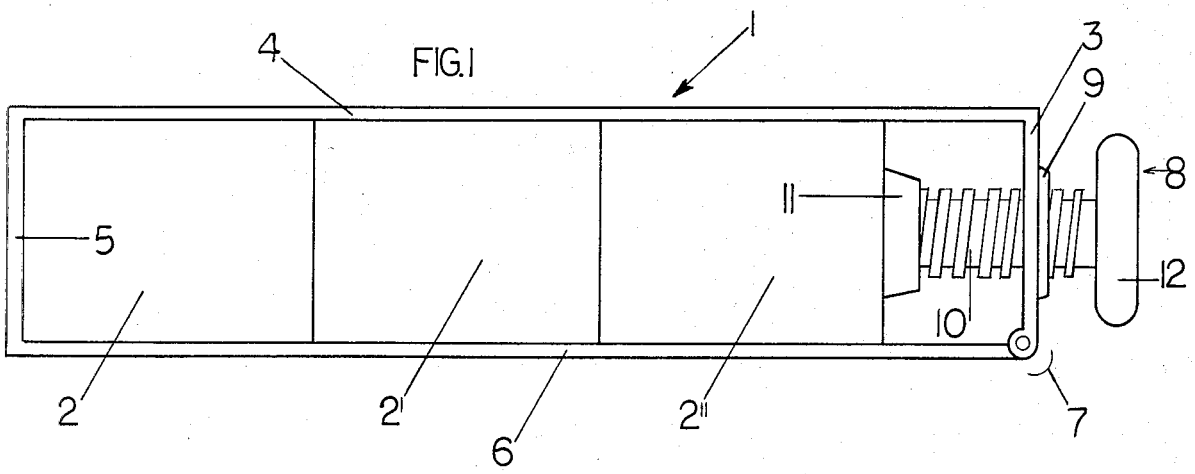
FIG. 1 shows a side view of the clamp in clamped relation to a three-plank scaffold.

In referring to the drawings and to FIG. 1 in particular, it will be seen that the present scaffold clamp 1 may be utilized to hold a plurality of planks, 2, 2', 2'' securely in side-by-side relationship. This results in complete enclosure and stabilization of a multi-plank platform.

The clamp 1 is largely composed of a single strip of rigid material, desirably a metal such as steel, bent three times to form a working plate 3, a first bar 4, a butt member 5, and a second bar 6. Thus, the strip constitutes a rigid, rectangular enclosure means for the planks in which the terminal edges of the working plate 3 and second bar 6 are attached by a locking means 7, here illustratively shown as a common bolt-hinge assembly.

Extending longitudinally through the working plate 3 is a press screw 8. While the press screw 8 may take a variety of forms, it is here depicted as being composed of a threaded collar 9 through which extends a screw 10. At the internal end of screw 10 is a head 11 designed to exert pressure over a relatively larger area. At the other end, screw 10 has a simple handle 12 to facilitate turning.

By rotating the press screw 8, the plank edges are forced together and against the butt member 5 of the device. The resulting friction prevents any one of the planks from flexing independently and increases the rigidity of the platform system quite remarkably. Conversely, the tension may be relieved to facilitate the disengagement of the locking means 7 and subsequent disassembly of the scaffold.

Figure 2:
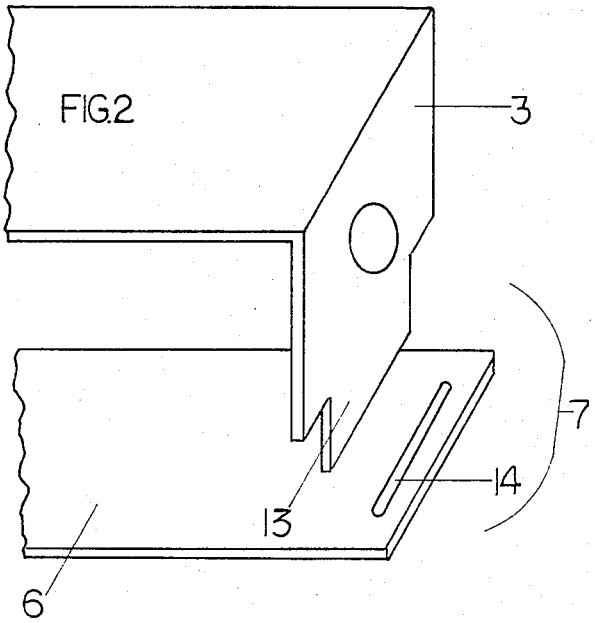
FIG. 2 is a perspective view of an optional embodiment of a working plate portion of the clamp.

Referring to FIG. 2, a preferred embodiment is shown in partial view. In this view, the working plate 3 (from which the press screw 8 has been removed to facilitate this view) terminates in end tongue 13. This end tongue 13 fits snugly into a lateral slot 14 through the second bar 6. Accordingly, after insertion and when tension is exerted through the press screw (not shown) this tongue and slot assembly forms a secure locking means 7.

Figure 3:
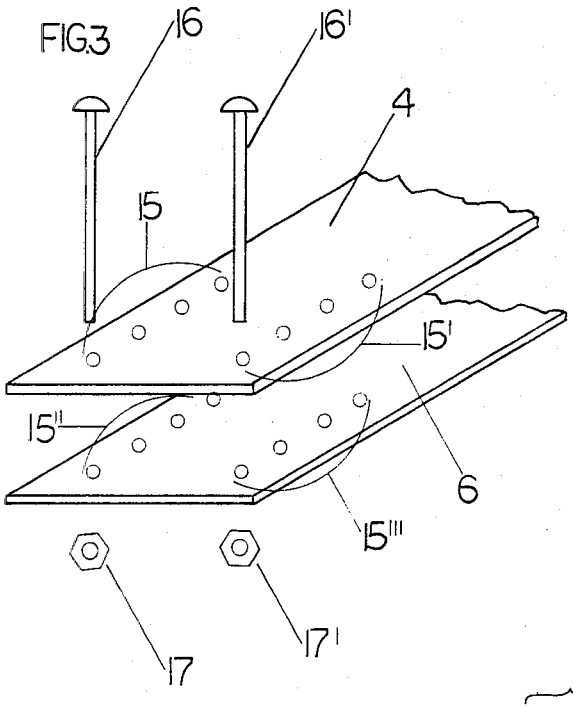
FIG. 3 is a perspective view of an optional embodiment of a butt member portion of the clamp.

FIG. 3 shows in partial view an optional construction for the butt member 5 of the clamp 1. There the first bar 4 and second bar 6 bear parallel series 15, 15', 15'' and 15''' of aligned holes. Through them may be inserted bolts 16 and 16' to be secured as shown with nuts 17 and 17'. In this embodiment, the bolts 16 and 16' together constitute an adjustable butt member against which planks may be forced by the press screw (not shown). Not only may they be utilized to accomodate differing widths of planks (not shown) for a platform but, in the event of a change in the thickness of the planks employed, they allow change in the separation distance between parallel bars 3 and 6. This ensures that the planks of the scaffold platform will be held securely together regardless of the direction of stress exerted.

Figure 4:
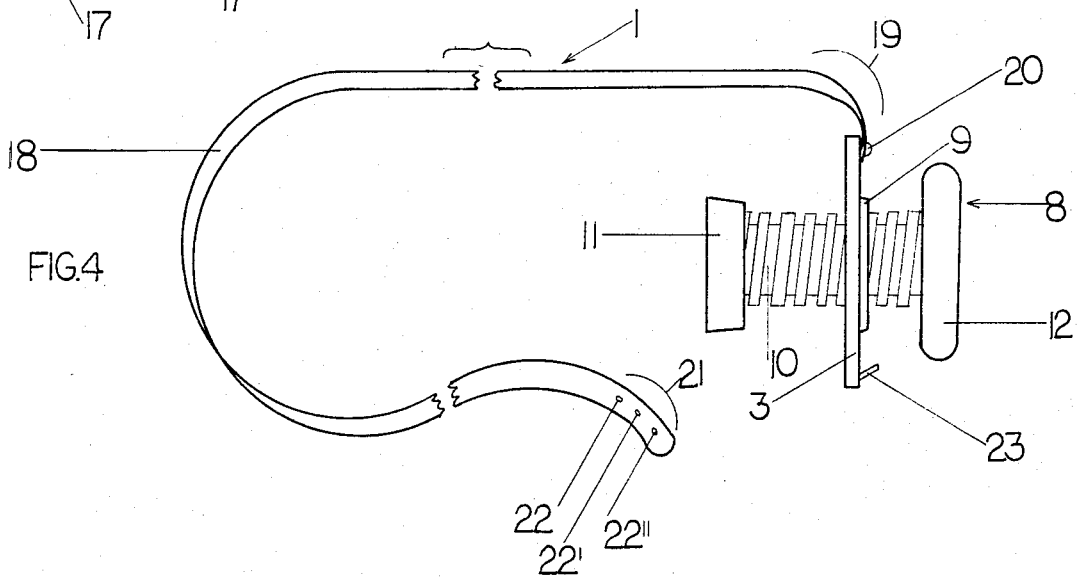
FIG. 4 is a perspective view of another embodiment of the clamp of the present invention.

Referring to FIG. 4, an embodiment of the present invention utlizing a flexible enclosure means for a platform is shown. The clamp 1 is largely composed of a flexible strap 18 having a length at least sufficient to circumscribe all the planks of the platform (not shown). One strap end 19 is attached to a rigid metal plate comprising the working plate 3 of the clamp 1 by a rivet 20. The opposite strap end 21 bears a series of holes 22, 22', 22", any one of which may be inserted over peg 23 to allow a releasable attachment to working plate 3. The press screw 8 (constructed as previously described) extending through the working plate 3 may, when the strap 18 and working plate 3 are assembled to enclose or circumscribe a platform, be tightened to exaust any slack in strap distance and so tension the entire clamp 1.

In utilizing the clamps of the present invention, the planks may first be laid across any pair of suitable supports. Then the present clamps may be assembled about the planks and tightened to exert desirable pressure. Because of the simplicity of these clamps, this is readily accomplished. In the embodiments of this invention when the enclosure means is composed largely of a rigid material such as sheet steel, all the clamps retain sufficient flex to allow this procedure. The embodiments utilizing a strap, such as a flexible canvas belt, may be still more easily assembled about the planks.

While several of the present clamps may be applied to a scaffold platform, only one is required. The clamp will hold the planks side-by-side to prevent dangerous separations from occuring. Footing on such a platform is not appreciably hindered due to the nearly flush mounting nature of the parallel bars or strap.

The present clamps are preferably constructed to accomodate two or more two inch thick conventional scaffold planks or alternatively two or more conventional framing lumber members at one and one-half inch thickness. The length of the planks is of no object except that the advantage of the clamps increases markedly when the planks span ten feet, twelve feet and more.

Where a metallic enclosure means is utilized, the first bar of the clamp normally lies on the top of the planks when in use. It is therefore desirably quite thin—e.g. from one-eight to one-quarter inch—to minimize the possibility of a user tripping over it. Its lateral edges may also be beveled in order to further reduce this risk. Generally, the other bar, and optionally the working plate and butt member, are of the same or similar dimensions and material. Where a flexible strap or belt is employed, its thinness also minimizes the possibility of tripping.

Variations as are known in the art may be utilized with the present invention. Similarly, portions of the improvements described herein may be employed without, or in combination with, others. Such changes and modifications do not depart from the scope of this invention.

What is claimed is:

1. A scaffold clamp for securing a plurality of planks in side-by-side relationship comprising a rectangular enclosure means dimensioned to circumscribe said planks, said enclosure means comprising first and second rigid bars in parallel relationship, one pair of adjacent ends of said bars being joined through an essentially perpendicular butt member relatively shorter in length than said bars, the opposite end of said first bar being angled inwardly to form an essentially perpendicular working plate terminating in a locking means for attachment with the adjacent end of said second bar, said enclosure means bearing a press screw extending longitudinally through said plate for exerting pressure against the edges of planks enclosed by said clamp.

2. The clamp of claim 1, wherein the locking means comprises an end tongue extending from the working plate through a lateral slot in the second bar.

3. The clamp of claim 1, wherein the first and second bars comprise sections of a one-piece metal strip bent inwardly in a pair of approximately right angles to form the butt member therebetween.

4. The clamp of claim 1, wherein the effective length of the parallel bars is variable by means of adjusting the location of the butt member.

5. The clamp of claim 1, wherein the length of the butt member is adjustable to separate the parallel bars in accomodation of planks of varying thickness.

6. The clamp of claim 5 wherein the effective length of the parallel bars is variable by means of adjusting the location of the butt member.

* * * * *